US005803765A

United States Patent [19]

Peloza et al.

[11] Patent Number: 5,803,765

[45] Date of Patent: Sep. 8, 1998

[54] ELECTRICAL CONNECTOR WITH UNIVERSAL BOARDLOCK

[75] Inventors: Kirk B. Peloza; Dennis W. Berek, both of Naperville; Gary E. Polgar, Bolingbrook; Edward S. Sommer, Addison; Rupert J. Fry, Mount Prospect; John S. Luthy, Naperville; Keith Samuel Maranto, Frankfort, all of Ill.

[73] Assignee: Molex Incorporated, Lisle, Ill.

[21] Appl. No.: 627,671

[22] Filed: Apr. 2, 1996

[51] Int. Cl.[6] ..... H01R 13/66

[52] U.S. Cl. ..... 439/567

[58] Field of Search ..... 439/567, 571, 439/554, 558, 557

[56] References Cited

U.S. PATENT DOCUMENTS

| | | | |
|---|---|---|---|
| 4,668,040 | 5/1987 | Matsuzaki et al. | 339/125 |
| 4,681,389 | 7/1987 | Nakazawa et al. | 439/557 |
| 4,907,987 | 3/1990 | Douty et al. | 439/571 |
| 5,074,807 | 12/1991 | Parmer | 439/553 |
| 5,080,611 | 1/1992 | Hypes | 439/567 |
| 5,135,412 | 8/1992 | Sitzler | 439/571 |
| 5,228,870 | 7/1993 | Gorenc et al. | 439/567 |
| 5,241,451 | 8/1993 | Walburn et al. | 439/567 |
| 5,393,247 | 2/1995 | DiOranzio et al. | 439/567 |
| 5,415,565 | 5/1995 | Mosquera | 439/567 |
| 5,419,713 | 5/1995 | Northey | 439/329 |
| 5,478,257 | 12/1995 | Cachina et al. | 439/567 |

OTHER PUBLICATIONS

Molex Full Line Catalog p. M–5 Jan., 1996.

*Primary Examiner*—Neil Abrams
*Assistant Examiner*—Eugene G. Byrd
*Attorney, Agent, or Firm*—Stephen Z. Weiss

[57] ABSTRACT

A surface mount electrical connector is adapted for mounting to the surface of a printed circuit board in either of two orientations generally perpendicular to each other. A molded dielectric housing has first and second board mounting faces disposed generally perpendicular to each other. A first boardlock-receiving passage is molded in the housing communicating with the first board mounting face and extending in a given direction which defines the direction of parting of a pair of mold dies for molding the housing. A second boardlock-receiving passage is molded in the housing generally perpendicular to the first passage and communicating with the second board mounting face. Each passage includes a set of bearing walls for engaging a boardlock member inserted into the respective passage, with no one bearing wall in either set thereof being in alignment with any other bearing wall in the other set thereof in said given direction. A universal boardlock member is insertable into either passage for selectively mounting either board mounting face of the housing to the printed circuit board.

11 Claims, 4 Drawing Sheets

ELECTRICAL CONNECTOR WITH UNIVERSAL BOARDLOCK

FIELD OF THE INVENTION

This invention generally relates to the art of electrical connectors and, particularly, to an electrical connector having a universal boardlock system for securing the connector to a printed circuit board in either of two generally perpendicular orientations.

BACKGROUND OF THE INVENTION

There are a variety of systems for securing an electrical connector to a printed circuit board. For example, the connector can have bores which align with corresponding openings in the printed circuit board. Fasteners then can be inserts through the bores and openings for securing the connector to the board. While these systems may be effective for securement, they are tedious and require substantial assembly time, as well as requiring numerous component parts. Separate tools also may be required to effect the securement.

Consequently, boardlocks, clips and the like have been designed for securing the electrical connector to the printed circuit board without the use of any tools. Such boardlocks or clips have been designed in numerous shapes and sizes. Generally, the boardlocks or clips pass through apertures in the electrical connector and the printed circuit board for securing the connector to the board. A typical boardlock might be stamped of metal material with barbs that establish an interference fit within an aperture in the connector housing, and with a bifurcated securing portion for insertion into a hole in the printed circuit board.

There are applications wherein it is desirable to have an electrical connector with a housing that can be mounted to the printed circuit board in one of two different positions perpendicular to each other. This requires the connector housing, which typically is unitarily molded of dielectric material such as plastic or the like, to be molded with apertures or boardlock-receiving passages perpendicular to each other. Heretofore, molding such perpendicular, usually intersecting, passages has required complicated molding techniques, typically requiring a pair of separable mold dies as well as one or more side-action dies. Such manufacturing techniques and the required tooling is relatively complicated and expensive.

The present invention is directed to solving these problems by providing a boardlock system wherein the connector can be mounted on a printed circuit board in either of two positions generally perpendicular to each other, yet the connector housing can be molded simply by a conventional pair of separable mold dies.

SUMMARY OF THE INVENTION

An object, therefore, of the invention is to provide a new and improved surface mount electrical connector adapted for mounting to the surface of a printed circuit board in either of two orientations generally perpendicular to each other.

In the exemplary embodiment of the invention, the connector includes a molded dielectric housing having first and second board mounting faces disposed generally perpendicular to each other. A first boardlock-receiving passage is provided in the housing communicating with the first board mounting face and extending in a given direction which defines the direction of parting of a pair of mold dies for molding the housing. A second boardlock-receiving passage is provided in the housing generally perpendicular to the first passage and communicating with the second board mounting face. Each passage includes a set of bearing walls for engaging a boardlock inserted into the respective passage, with no one bearing wall in either set thereof being in alignment with any other bearing wall in either set thereof in said given direction. Boardlock means are insertable into the passages for selectively mounting either board mounting face of the housing to the printed circuit board.

As disclosed herein, the boardlock means comprise a universal boardlock member stamped and formed of sheet metal material with edge portions engageable with the bearing walls of the boardlock-receiving passages. The universal boardlock member is insertable into either of the passages. The boardlock member has a wide body portion and a narrow head portion for engagement by the bearing walls of the boardlock-receiving passages.

Another feature of the invention is that the stamped and formed boardlock member includes a locking tab stamped and formed out of the sheet metal of the body portion of the member. The locking tab is effective to skive into planar wall means of the boardlock-receiving passages.

Other objects, features and advantages of the invention will be apparent from the following detailed taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
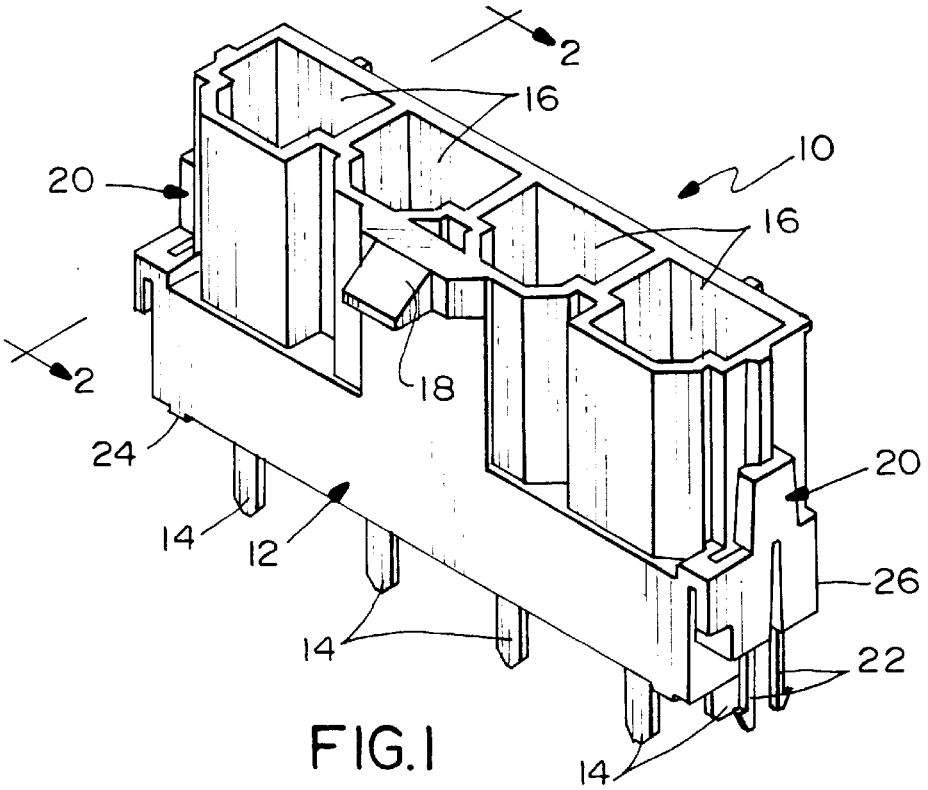
FIG. 1 is a perspective view of an electrical connector embodying a first embodiment of the invention.

Referring to the drawings in greater detail and first to FIG. 1, an electrical connector, generally designated 10, is shown to incorporate a first embodiment of the boardlock system of the invention. The connector includes a housing, generally designated 12, which is unitarily molded of dielectric material such as plastic or the like. The housing mounts a plurality of conductive terminals, only tail portions 14 of the terminals being visible in the drawings. The housing has a plurality of mating receptacles 16 for receiving terminal silos of a complementary mating connector (not shown). One side of the housing includes a latch 18 for interengagement with a complementary latch structure of the mating connector. Lastly, a boardlock mounting structure, generally designated 20, is integrally molded at each opposite end of housing 20. Leg portions 22 of one of the boardlocks (described hereinafter) according to the invention are shown depending from the right-hand boardlock mounting structure 20 in FIG. 1.

It should be understood that the invention herein may be incorporated in a wide variety of electrical connectors other than the configuration or type of connector represented by connector 10 in FIG. 1. In other words, other than the boardlock mounting structure 20 and the boardlocks described hereinafter, the particular configuration of the connector housing, terminals etc. can be varied considerably within the teachings of the present invention.

Figure 2:
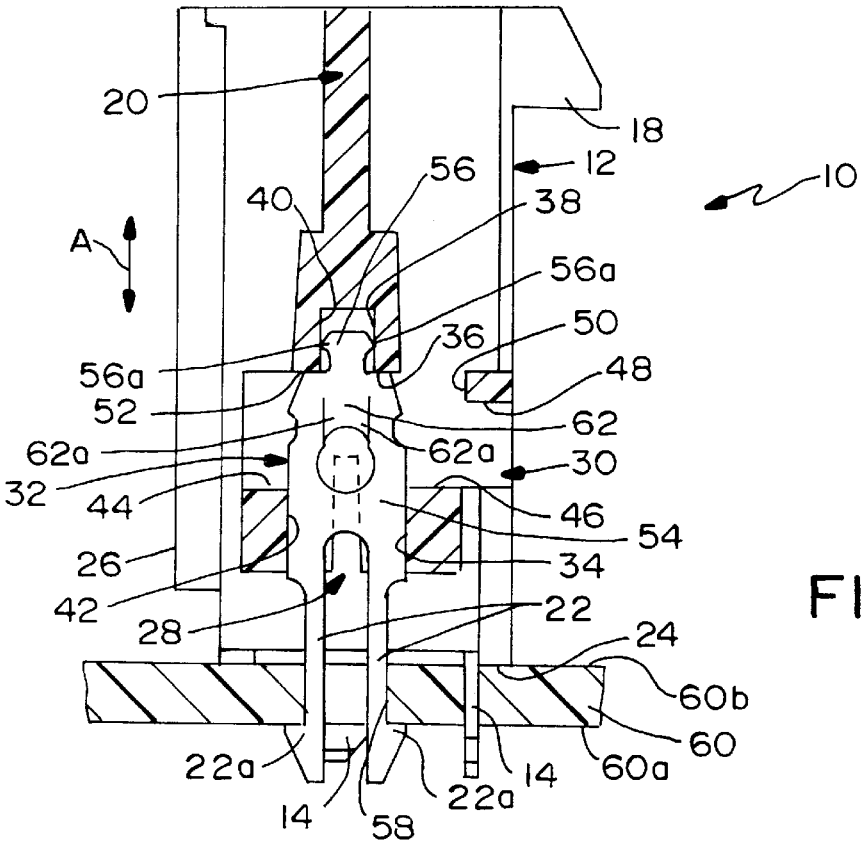
FIG. 2 is a vertical section taken generally along line 2—2 of FIG. 1, with the connector mounted to a printed circuit board.
Figure 3:
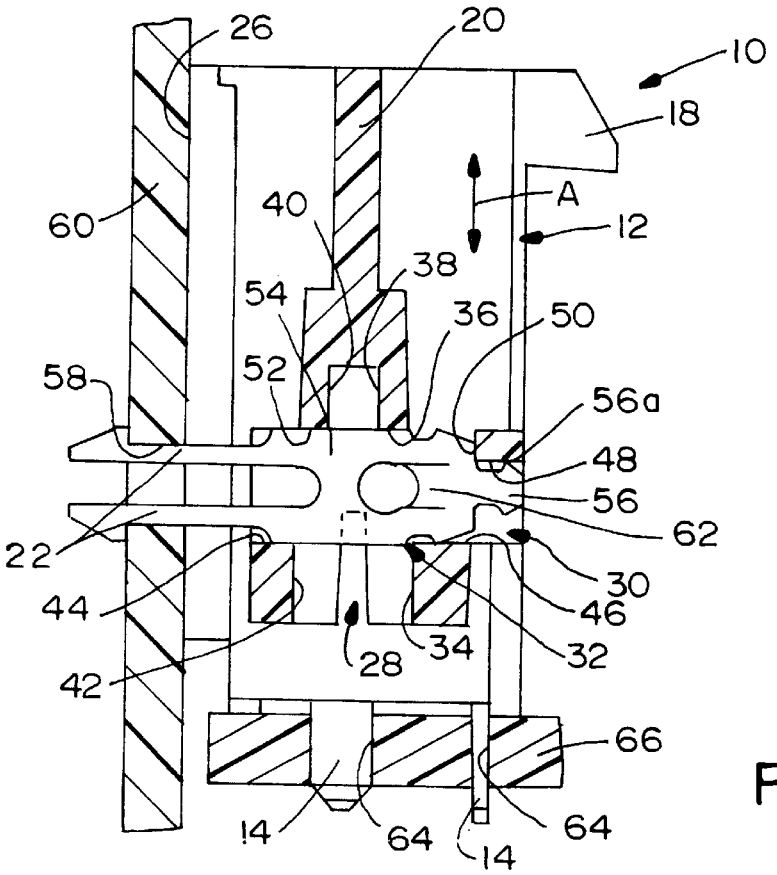
FIG. 3 is a view similar to that of FIG. 2, but with the connector mounted to a printed circuit board generally perpendicular to the orientation of FIG. 2.

Referring to FIGS. 2 and 3 in conjunction with FIG. 1, molded dielectric housing 12 includes a first board mounting face 24 and a second board mounting face 26 disposed generally perpendicular to each other for facilitating mounting housing 12 and, thus, connector 10 in either of two orientations generally perpendicular to each other. This is shown by comparing the two different perpendicular orientations in FIGS. 2 and 3.

Figure 7:
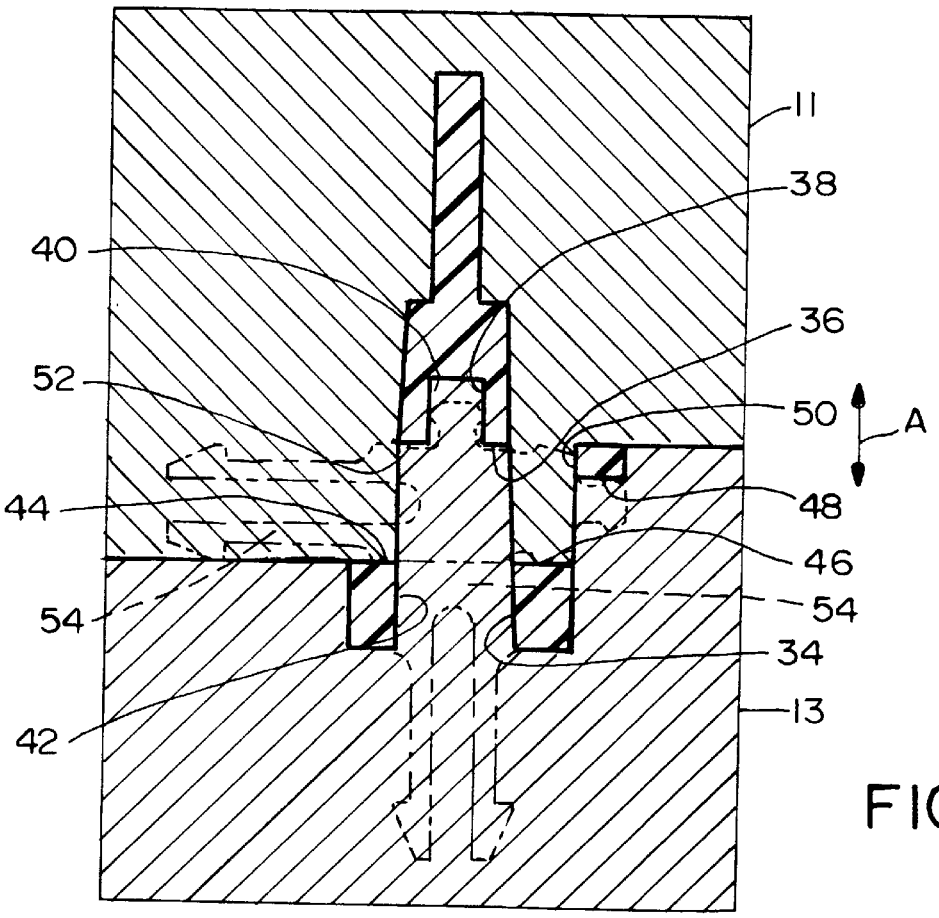
FIG. 7 is a cross section view of mold dies used to form the first embodiment shown in FIG. 1, 2 and 3.

As stated in the "Background", above, the invention is directed to providing such a multi-orientation connector, along with the boardlock system therefor, wherein connector housing 12 can be molded by only a pair of mold dies 11 and 13. Consequently, double-headed arrows "A" in FIGS. 2, 3 and 7 represent the direction of parting of the pair of mold dies 11 and 13 for molding housing 12. With that understanding, a first boardlock-receiving passage, generally designated 28, is molded within housing 12 communicating with the first board mounting face 24 and extending in the direction "A" of parting of the pair of mold dies. A second boardlock-receiving passage, generally designated 30, is molded in housing 12 generally perpendicular to first passage 28 and communicating with the second board mounting face 26. Although the mutually perpendicular boardlock-receiving passages 28 and 30 are described as being molded within housing 12, technically the passages are molded within each boardlock mounting structure 20 at each opposite end of the housing as described above in relation to FIG. 1.

Each passage 28 and 30 includes a set of bearing walls for engaging a universal boardlock member, generally designated 32, inserted into the respective passage. More particularly, the first boardlock-receiving passage 28 includes bearing walls 34, 36, 38, 40 and 42. The second boardlock-receiving passage 30 incudes bearing walls 44, 46, 48, 50 and 52.

Before proceeding with a description of the significance of locating the bearing walls of the boardlock-receiving passages, a description of boardlock 32 is warranted. It should be understood that an identical or universal boardlock member is fabricated for insertion into either of the first or second boardlock-receiving passages 28 or 30, respectively.

Specifically, boardlock member 32 is stamped and formed of sheet metal material and includes a body portion 54 with a head portion 56 projecting from one end of the body portion, and with bifurcated leg portions 22 projecting from the opposite end of the body portion. As seen in FIG. 2, legs 22 are insertable through a hole 58 in a printed circuit board 60. The legs have outwardly projecting hook portions 22*a* for snapping behind a surface 60*a* of the printed circuit board opposite a surface 60*b* which engages first board mounting face 24 of the connector housing. A locking tab 62 is stamped and formed out of body portion 54 of the boardlock member, with the locking tab having pointed tips 62*a* which will skive into the plastic material of the housing within boardlock-receiving passages 28 and 30 to prevent the boardlock from being pulled back out of either passage.

When it is desired to mount connector 10 to a printed circuit board with first board mounting face 24 engaging the board in the orientation of FIG. 2, one of the universal boardlock members 32 is inserted into each of the first boardlock-receiving passages 28 at each opposite end of the connector housing, as clearly shown in FIG. 2. The connector then can be mounted to the board by inserting legs 22 through holes 58 in the board. When the boardlock member is in the respective passage 28, opposite side edges of body portion 54 of the stamped member engage bearing walls 34 and 42 which define opposite sides of the passage. Opposite pointed edges 56*a* of head portion 56 of the member engage and skive into bearing walls 38 and 40. Forwardly facing shoulder edges of body portion 54 engage bearing walls 36 and 52. Bearing walls 36, 44, 46, 48 and 52, which are perpendicular to the direction of double-headed arrow "A", extend between planes defined by bearing walls 34, 38, 40, 42 and 50, which are generally parallel to direction "A". This relationship between the perpendicular and parallel bearing walls insures that no one bearing wall 34, 36, 38, 40, 52 or 42 for the board lock 54 inserted into passage 28 will be in alignment with each other in the direction of double-headed arrow "A" which defines the direction of parting of the pair of mold dies 11 and 13. Therefore, all of the bearing surfaces of mounting structure 20 for engaging the boardlock member to mount the connector in the orientation of FIG. 2 can be molded solely by two parting mold dies 11 and 13.

Turning to FIG. 3, one of the identical or universal boardlock members 32 is shown inserted into the second boardlock-receiving passage 30 which allows for the connector housing 12 and, thus, connector 10 to be mounted to circuit board 60 in an orientation perpendicular to that of FIG. 2. In other words, second board mounting face 26 of the housing now engages the board. This orientation may be desirable in a mother board/daughter board application wherein terminals 14 are insertable into holes 64 of a second printed circuit board 66 arranged perpendicular to the first printed circuit board 60.

Regardless of the application, when universal boardlock member 32 is inserted into second boardlock-receiving passage 30 as shown in FIG. 3, opposite edges of the stamped body portion 54 of the boardlock member engage bearing walls 44, 46, 36 and 52. The left-hand pointed edge 56*a* of head portion 56 of the boardlock member engages bearing wall 48, and the left-hand shoulder edge of the body portion engages bearing wall 50.

When boardlock member 32 is inserted into second boardlock-receiving passage 30 as shown in FIG. 3, it can be seen that the relationship between the perpendicular and parallel bearing walls insures that no one bearing wall 44, 46, 48, 50, 36 or 52 of passage 30 is in alignment with any other bearing wall in the direction of parting of the pair of mold dies 11 and 13 as represented by double-headed arrow "A". Therefore, in combining the above description of the bearing walls for the first boardlock-receiving passage 28 with this description of the bearing walls for the second boardlock-receiving passage 30, it can be understood that both boardlock-receiving passages are capable of being formed by only two separable mold dies 11 and 13 as shown in FIG. 7 without using a side action die. Yet, the connector can be mounted in two different, mutually perpendicular orientations to a printed circuit board using identical or universal boardlock members.

Figure 4:
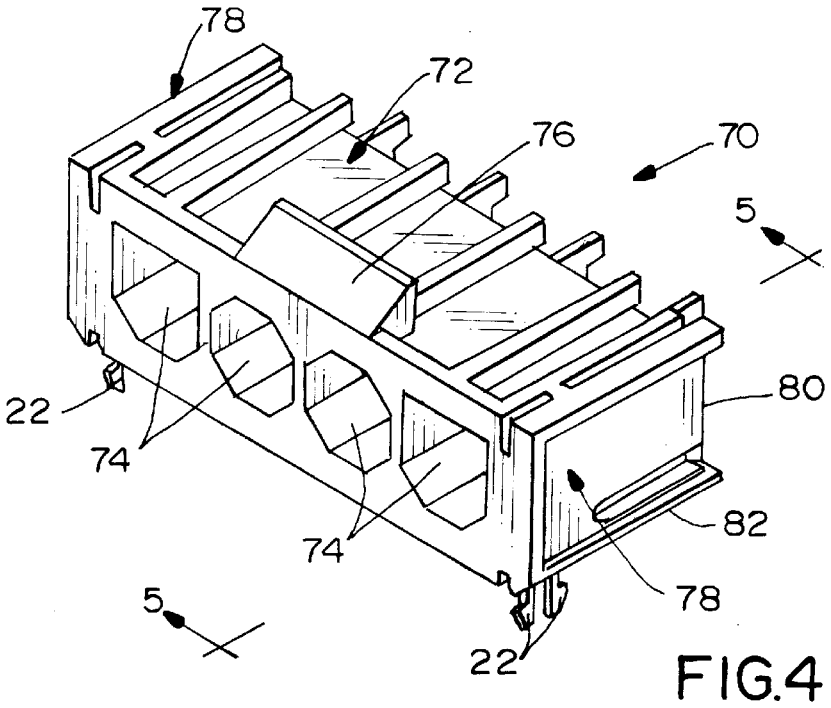
FIG. 4 is a perspective view of an electrical connector incorporating a second embodiment of the invention.
Figure 6:
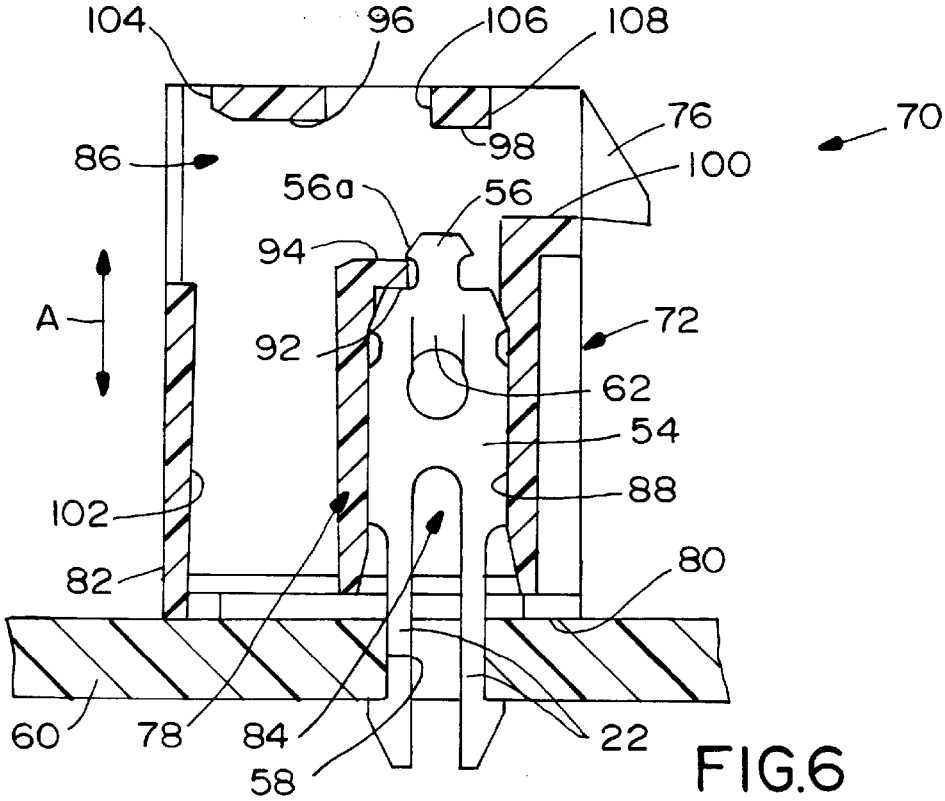
FIG. 6 is a view similar to that of FIG. 5, but with the connector mounted to a printed circuit board generally perpendicular to the orientation of FIG. 5.
Figure 5:
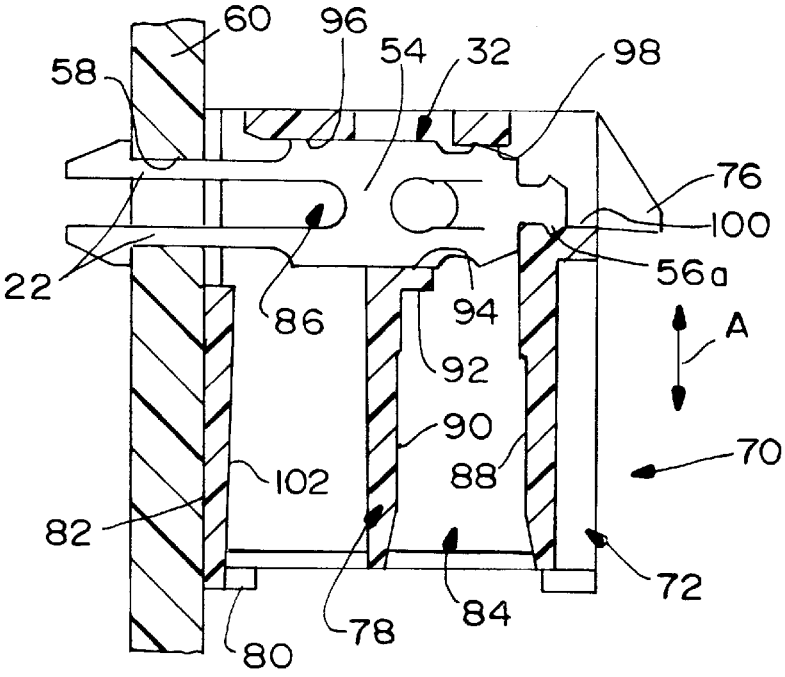
FIG. 5 is a vertical section taken generally along line 5—5 of FIG. 4, with the connector mounted to a printed circuit board.

FIGS. 4–6 show a second connector, generally designated 70, which is similar to connector 10 in that it includes a unitarily molded dielectric housing, generally designated 72, having receptacles 74 and a latch 76 for cooperation with a complementary mating connector (not shown). A boardlock-mounting structure 78 is molded at each opposite end of the housing. The housing defines a first board mounting face 80 and a second board mounting face 82 for mounting the connector in either of two orientations generally perpendicular to each other, as seen in comparing FIGS. 5 and 6. Again, each boardlock mounting structure 78 is configured so that the housing can be molded by conventional means employing only two mold dies 15 and 17 separable in the direction indicated by double-headed arrow "A".

The second embodiment of FIGS. 4–6 employs the same identical or universal boardlock member 32 and, consequently, like numerals have been applied to portions of the boardlock member as described above and shown in the first embodiment of FIGS. 1–3.

Referring to FIGS. 5 and 6, each boardlock mounting structure 78 again includes a first boardlock-receiving passage, generally designated 84, communicating with board mounting face 80 and extending in the direction of parting of the pair of mold dies 15 and 17 as indicated by double-headed arrow "A". A second boardlock-receiving passage, generally designated 86, extends generally perpendicular to first passage 84 and communicates with second board mounting face 82.

First boardlock-receiving passage 84 includes a pair of opposing bearing walls 88 and 90 for engaging opposite edges of the body portion 54 of the boardlock member, a forward bearing wall 92 for engaging one of the forwardly facing shoulders of the body portion, and a bearing wall 94 behind which one of the pointed edges 56*a* of the head portion 56 of the boardlock engages. When the boardlock is inserted into the second boardlock-receiving passage 86 as shown in FIG. 5, opposite edges of body portion 54 of the boardlock are engaged by bearing walls 96 and 98 at one side of the passage and the bearing wall 94 at the opposite side of the passage. Bearing wall 88 of passage 84 also engages the right-hand front shoulder of the body portion of the boardlock as seen in FIG. 5. Lastly, the right-hand pointed edge 56*a* of the head portion of the boardlock skives into a bearing wall 100 at the extreme inner end of passage 86.

Figure 8:
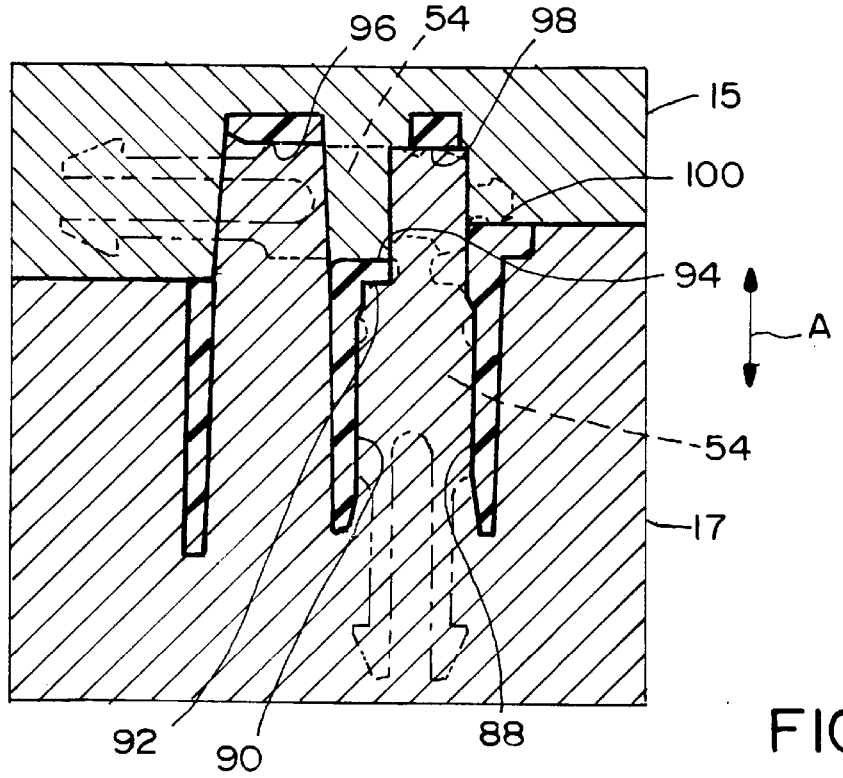
FIG. 8 is a cross section view of mold dies used to form the second embodiment shown in FIGS. 4, 5 and 6.

As described above in relation to all of the bearing walls of boardlock-receiving passages 28 and 30 in the first embodiment of the invention, all of bearing walls 88, 90, 92, 94, 96, 98 and 100 of boardlock-receiving passages 84 and 86 are located and face in various directions so that passages 84 and 86 can be molded by only two mold dies 15 and 17 without using a side action die which part in the direction of double-headed arrows "A" in FIGS. 5, 6 and 8. This is facilitated by allowing the mold dies to move through open areas 102, 104, 106 and 108 of the board mounting structures 78 as well as through the boardlock-receiving passages 84 and 86.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A surface mount electrical connector adapted for mounting to the surface of a printed circuit board in either of two orientations generally perpendicular to each other, comprising:

a molded dielectric housing having first and second board mounting faces disposed generally perpendicular to each other, the housing adapted for molding by only two mold dies separable in a given parting direction, a first boardlock-receiving passage in the housing communicating with the first board mounting face and extending in the given parting direction of the two separable mold dies, a second boardlock-receiving passage in the housing generally perpendicular to the first passage and communicating with the second board mounting face, each passage including a set of bearing walls for engaging a boardlock means inserted into the respective passage with no one bearing wall in either set thereof being in alignment with any other bearing wall in the other set thereof in said given direction, and boardlock means insertable into said passages for selectively mounting either board mounting face of the housing to the printed circuit board.

2. The surface mount electrical connector of claim 1 wherein said boardlock means comprise a universal boardlock member insertable into either of said passages in engagement with the respective set of bearing walls thereof.

3. The surface mount electrical connector of claim 1 wherein said boardlock means comprise a boardlock member having a wide body portion and a narrow head portion for engagement by the bearing walls of the boardlock-receiving passages.

4. The surface mount electrical connector of claim 3 wherein the body portion of said boardlock member includes a locking tab for skiving into planar wall means of the boardlock-receiving passages.

5. The surface mount electrical connector of claim 1 wherein said boardlock means comprise a boardlock member stamped and formed of sheet metal material with edge portions engageable with the bearing walls of the boardlock-receiving passages.

6. The surface mount electrical connector of claim 5 wherein said boardlock member include a locking tab stamped and formed out of sheet metal material remote from the edges of the member.

7. A surface mount electrical connector adapted for mounting to the surface of a printed circuit board in either of two orientations generally perpendicular to each other, comprising:

a molded dielectric housing having first and second board mounting faces disposed generally perpendicular to each other, a first boardlock-receiving passage in the housing communicating with the first board mounting face and extending in a given direction which defines the direction of parting of a pair of mold dies for molding the housing, a second boardlock-receiving passage in the housing generally perpendicular to the first passage and communicating with the second board mounting face, each passage including a set of bearing walls for engaging a boardlock member inserted into the respective passage, some of the bearing walls being perpendicular to said given direction and some other of the bearing walls being parallel to the given direction, the bearing walls perpendicular to said given direction extending between planes defined by the bearing walls parallel to said given direction so that no one bearing wall in either set thereof being in alignment with any other bearing wall in either set thereof in said given direction, and a universal boardlock member insertable into either of said passages, the boardlock member being stamped and formed of sheet metal material and having a wide body portion and a narrow head portion each with edges engageable with the bearing walls of the boardlock-receiving passages.

8. The surface mount electrical connector of claim 7 wherein the body portion of said boardlock member includes a stamped and formed locking tab for skiving into wall means of the boardlock-receiving passages.

9. A surface mount electrical connector adapted for mounting to the surface of a printed circuit board in either of two orientations generally perpendicular to each other, comprising:

a molded dielectric housing adapted for molding by only two mold dies separable in a given parting direction, a pair of boardlock-receiving passages in the housing for receiving boardlock means with the passages extending perpendicular to each other and the passages being configured for molding by said two mold dies; and boardlock means insertable into said passages for selectively mounting the housing and, thus, the connector to the printed circuit board in either of said two orientations.

10. The surface mount electrical connector of claim 9 wherein said boardlock means comprise a universal boardlock member insertable into either of said passages.

11. The surface mount electrical connector of claim 10 wherein said boardlock member is stamped and formed of sheet metal material with edge portions engageable with the housing within the passages.

* * * * *